US007097276B2

(12) United States Patent
Itoh

(10) Patent No.: US 7,097,276 B2
(45) Date of Patent: Aug. 29, 2006

(54) IMAGE FORMING APPARATUS

(75) Inventor: Yuichiro Itoh, Daito (JP)

(73) Assignee: Funai Electric Co., Ltd., Daito (JP)

( * ) Notice: Subject to any disclaimer, the term of this patent is extended or adjusted under 35 U.S.C. 154(b) by 257 days.

(21) Appl. No.: 10/892,225

(22) Filed: Jul. 16, 2004

(65) Prior Publication Data

US 2005/0018010 A1 Jan. 27, 2005

(30) Foreign Application Priority Data

Jul. 17, 2003 (JP) ..... 2003-198176

(51) Int. Cl.
*B41J 2/165* (2006.01)

(52) U.S. Cl. ..... 347/35; 347/36

(58) Field of Classification Search ..... 347/22, 347/24, 29, 30, 32, 35, 36
See application file for complete search history.

(56) References Cited

U.S. PATENT DOCUMENTS 6,213,583 B1 * 4/2001 Therien ..... 347/36
6,273,547 B1 * 8/2001 Aldrich ..... 347/36
6,340,200 B1 * 1/2002 Gaylor et al. ..... 347/35
6,644,779 B1 * 11/2003 Aldrich et al. ..... 347/36

FOREIGN PATENT DOCUMENTS

JP 2001-293887 10/2001

* cited by examiner

*Primary Examiner*—Shih-Wen Hsieh
(74) *Attorney, Agent, or Firm*—Crowell & Moring LLP

(57) ABSTRACT

The ink receiving cup is provided with a cylindrical top portion, a bearing portion into which the center shaft of rotation is fitted when the ink receiving cup is rotated at the central portion, a black ink accumulating portion where blank ink is sprayed and accumulated, and a plurality of through-holes at the outer-circumferential side and inner-circumferential side of the black ink accumulating portion for causing color inks to flow.

3 Claims, 3 Drawing Sheets

IMAGE FORMING APPARATUS

BACKGROUND OF THE INVENTION

1. Field of the Invention

The present invention relates to an image forming apparatus capable of forming a document image having images and (or) characters on the surface of a medium by causing ink to be sprayed onto the corresponding medium.

2. Description of the Related Art

An image forming apparatus for forming a document image having images and (or) characters on the surface of a medium by causing ink to be sprayed onto the corresponding medium such as a printing paper includes medium feeding rollers for feeding the above-described medium and a carrier that reciprocates while holding ink cartridges in which ink is sealed.

The above-described image forming apparatus includes a printing area, into which the above-described medium is fed, for printing a document image composed of images and (or) characters and a maintenance area in which the carrier having ink cartridges mounted thereon is disposed while the above-described printing is not carried out.

The ink cartridges mounted on the above-described carrier has nozzles for discharging the above-described ink. A black ink cartridge in which a black ink for black printing is sealed and a color ink cartridge in which a cyan ink, magenta ink, and yellow ink (so-called "color inks") for color printing are, respectively, divided and sealed are mounted on the above-described carrier adjacent to each other.

The above-described carrier and ink cartridges move to the above-described maintenance area after printing is finished. Further, where no operation is carried out for a prescribed period of time, the carrier and ink cartridges move to the home positions secured in the maintenance area and stand by therein where the main power source of the above-described image forming apparatus is turned off. At this time, the nozzles of the respective ink cartridges are capped in order to prevent ink from drying up in the respective nozzles. The caps are fixed on a movable member called a "sled," and the corresponding sled is elevated from downward of the carrier in line with the movement of the above-described carrier to the home position, wherein the above-described caps are placed on the respective nozzles.

Also, in printing, excessive ink adhered to the nozzles and to the vicinity thereof is wiped off by the nozzle wiper secured at the above-described sled immediately after commencing an operation, and the above-described carrier and the above-described ink cartridges, which are disposed at the above-described home position, move to the printing area. Since excessive ink adhered to the nozzles and to the vicinity thereof is wiped off by the nozzle wiper, it is possible to increase the accuracy of printing on the above-described medium, and it is possible to lessen printing stains.

However, there is a case where it is insufficient that only the excessive ink adhered to the above-described nozzles and the vicinity thereof is wiped off by the nozzle wiper. In such a case, a type has been proposed, which carries out preliminary discharge, that is, discharges ink through the nozzles of the above-described ink cartridges at a position (that is, a position in which the nozzles and caps are not lined up straightly, hereinafter called a "preliminary discharge position") where the above-described carrier and ink cartridges slightly moved from the above-described home position.

In a case of an image forming apparatus in which the above-described preliminary discharge is carried out, there are many cases where portions onto which ink is applied by the preliminary discharge of the above-described sled are provided with ink-release ports in order to lessen the corresponding ink is adhered to the sled.

However, although color inks having lower viscosity flow out by repeating the preliminary discharge at the above-described preliminary discharge position, black ink having high viscosity is accumulated downward of the corresponding preliminary discharge position, and is gradually adhered to the above-described sled and (or) carrier, thereby hindering movements of the corresponding sled and (or) carrier.

Therefore, such a type has been proposed, which an ink receiving cup to receive ink discharged from the above-described preliminary discharge is disposed at a position downward of the ink release ports of the above-described sled when the above-described ink cartridges carry out preliminary discharge at the above-described preliminary discharge position.

The ink receiving cup is saucer-shaped which is circular in its plan view, and slightly turns whenever preliminary discharge is carried out, wherein preliminary discharge is carried out at a position slightly shifted from the previous preliminary discharge position in respective preliminary discharge. Thereby, since the preliminary discharge is carried out at different positions, it is possible to lessen accumulation of black ink.

Some rotation mechanisms are available with respect to the above-described ink receiving cup, in one of which the ink receiving cup is rotated by a motor, and in another of which serrated projections and recesses are formed on the outer circumferential face of the above-described ink receiving cup, and the projections and recesses are pressed in one direction by a rotating member secured on the underside of the above-described sled, as disclosed in JP-A-2001-293887.

However, it is possible to improve the printing accuracy without hindering movements of the above-described sled and carrier due to accumulation of the above-described black ink by carrying out preliminary discharge of the corresponding black ink. The above-described preliminary discharge is carried out for the nozzle of a color ink cartridge, wherein the above-described ink receiving cups are filled with color ink by executing the preliminary discharge several times. Therefore, if the above-described preliminary discharge is carried out in a state where the above-described ink receiving cups are filled with color ink, the above-described black ink and (or) the above-described color inks are discharged into the color inks in the above-described ink receiving cups. Therefore, color inks are splattered.

The splattered color ink is adhered to the nozzles of the black ink cartridge and color ink cartridge and to the vicinity thereof, resulting in such troubles, which lower the printing accuracy and form printing stains on the above-described medium.

SUMMARY OF THE INVENTION

It is an object of the invention to provide an image forming apparatus capable of carrying out preliminary discharge without hindering movements of movable portions such as the carrier, sled, etc., due to accumulation of black ink, and preventing stains of document images, which may occur by adhesion of splattered color inks, from being generated.

In order to achieve the above object, the present invention provides an image forming apparatus for printing a document image having images and (or) characters by spraying ink onto a medium; including: a carrier for holding a black ink cartridge and a color ink cartridge; nozzle caps for preventing ink, which exists in nozzles of the black ink cartridge and color ink cartridge and in the vicinity of the nozzles, from drying while the carrier is in standby for a next printing action; nozzle wipers for wiping off unnecessary ink existing in the nozzles of the black ink cartridge and color ink cartridge and in the vicinity thereof when the carrier commences an action from the standby state; a sled for supporting the nozzle caps and nozzle wipers and approaching the carrier in line with the movements of the carrier; and an ink receiver cup, which is disposed downward of the sled, for rotating in one direction in line with the movements of the sled; wherein the black ink cartridge and color ink cartridge carries out a so-called preliminary discharge by which ink is discharged from the nozzles to the ink receiver cup before commencing printing on a medium or by an instruction of a user; and the ink receiver cup has a plurality of flow-out pores, through which color inks flow out, formed at positions where the strength of the ink receiver cup is not remarkably lowered, at portions other than the part in which black ink is sprayed through the preliminary discharge.

According to the above-described construction, when carrying out preliminary discharge in order to prevent the nozzles of the black ink cartridge and color ink cartridge from stopping up, it is possible to prevent troubles resulting from adhesion of ink onto components of the image forming apparatus such as the above-described sled, carrier, etc.

In particular, it is possible to prevent movements of the components such as the above-described sled, carrier, etc., from being hindered due to that the corresponding black ink is accumulated at a portion where ink is discharged by preliminary discharge of black ink having high viscosity. In addition, it is possible to prevent various troubles from occurring. That is, troubles such that color inks having low viscosity are accumulated in the ink receiving cups, and if preliminary discharge is carried out to the accumulated inks, wherein the accumulated ink is splattered to stain or dirty the surroundings or to adhere to the nozzles of the ink cartridges, the accuracy of the document images are lowered, or the splattered ink is adhered to the medium, and it is stained with the splattered ink.

Also, according to the above-described construction, since no power source exclusively for the ink receiving cups such as a motor is required for movements of the ink receiving cups, the construction can be accordingly simplified. In addition, energy necessary to drive the entire image forming apparatus can be decreased.

In order to achieve the above-described object, the present invention is featured in that an image forming apparatus for printing a document image having images and (or) characters by spraying ink onto a medium includes an ink receiving member for receiving ink discharged in the preliminary discharge; wherein the ink receiving member includes an ink accumulating portion for accumulating ink having high viscosity and an ink discharging portion for discharging ink having low viscosity (having high fluidity); and, in the preliminary discharge, the ink accumulating portion accumulates the ink having high viscosity in a place differing from that for the preliminary discharge.

According to the construction, since ink having high viscosity is accumulated at different positions of the above-described ink accumulating portion whenever the above-described preliminary discharge is carried out, there are almost no cases where ink is adhered to other portions of the above-described image forming apparatus, and the movements of the image forming apparatus are hindered. Also, since ink having low viscosity (having high fluidity) is discharged through the discharge portion, the corresponding ink having low viscosity is not accumulated in the above-described ink receiving portion, and it is not accumulated in the above-described ink receiving member when carrying out preliminary discharge. Therefore, it is possible to prevent such troubles from occurring. That is, troubles such that ink having low viscosity, which is accumulated in the corresponding ink receiving member is splattered to stain or dirty the above-described image forming apparatus or is adhered to the medium to stain the document images.

In the above-described construction, the invention is featured in that the above-described ink receiving member is an ink receiving cup having a cylindrical shape with its top part open; the ink receiving cup includes, ink flow-out pores penetrating from the bottom plane to the outside, as the ink discharging portion; and the flow-out ports are circular arcs having a prescribed center angle and have a prescribed width in the radius direction, and the flow-out ports are disposed on the inner circumferential side and the outer circumferential side of the ink accumulating portion at intervals composed of an equal-center angle with respect to the center portion of the ink receiving cup.

According to the construction, even if the above-described ink having low viscosity is flown into the inner-circumferential side and the outer-circumferential side of the above-described ink accumulating portion since the above-described flow-out port is formed at both the inner-circumferential side and the outer-circumferential side of the above-described ink accumulating portion of the ink receiving cup, it is possible to prevent the ink from being accumulated because it flows out through the above-described flow-out port. Accordingly, it is possible to prevent various troubles from occurring, by which the above-described image forming apparatus is stained or made dirty or a document image is stained by adhesion of ink on the medium by splattering of ink having low viscosity, which is accumulated in the above-described ink receiving member.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1:
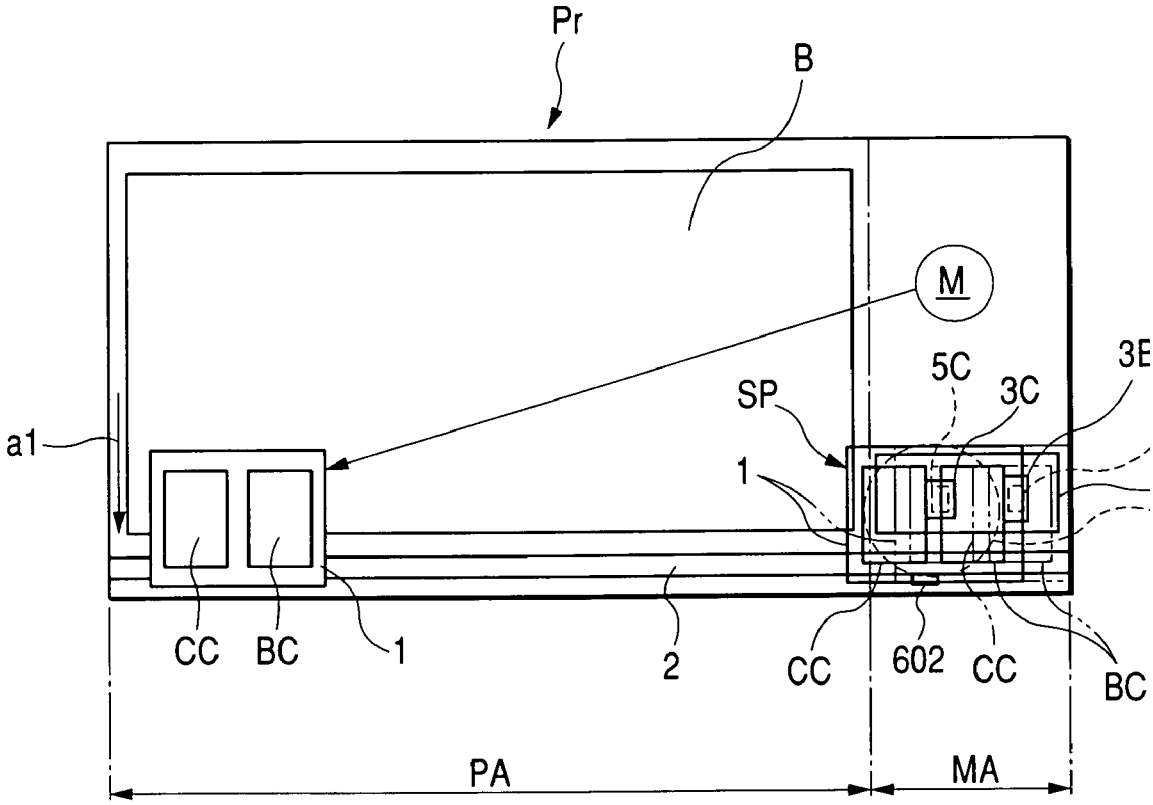
FIG. 1 is a general layout view of a printer which is an example of an image forming apparatus according to the present invention.

Hereinafter, a description is given of an embodiment of the present invention with reference to the accompanying drawings. FIG. 1 shows a general layout view of an ink jet printer that is one of the examples of an image forming apparatus according to the invention.

As shown in FIG. 1, a printer Pr includes: a carrier 1 having a color ink cartridge CC and a black ink cartridge BC mounted thereon; a horizontal shaft 2 for determining the movements of the carrier 1 when the carrier 1 sprays ink onto a medium B (herein, printing paper B) for printing; nozzles caps 3C and 3B for the color ink cartridge CC and black ink cartridge BC; a sled 4 for causing the nozzle caps 3C and 3B to ascend and descend in line with the movement of the carrier 1; a nozzle cap 3C for the color ink cartridge CC; an ink receiving cup 6 for receiving inks discharged in preliminary discharge which is carried out before the black ink cartridge BC and color ink cartridge CC execute printing on the printing paper B; and nozzle cap holders 5B and 5C for supporting the nozzle cap 3B for the black ink cartridge and nozzle cap 3C for the color ink cartridge.

Also, a motor M is used to drive the carrier 1. In addition, a belt drive (not illustrated) is employed for transmission of power from the motor M to the carrier 1, but the transmission is not limited to the belt drive.

The black ink cartridge BC and color ink cartridge. CC have nozzles BC1 and CC1 for discharging ink on the underside thereof. In addition, the carrier 1 moves between the printing area PA where the color ink cartridge CC and black ink cartridge BC are correctly positioned opposite to the medium B and the maintenance area MA at a position deviated from the medium B. When printing, the carrier 1 reciprocates with respect to the printing are PA and forms images on the medium B while discharging inks from the nozzles BC1 and CC1 of the black ink cartridge BC and color ink cartridge CC with the printing paper B fed in a prescribed direction (herein, in the direction of the arrow a1).

Further, as the printer Pr finishes printing on the printing paper B, the printing paper B is ejected to the outside of the printer Pr, and at the same time, the carrier 1 that holds the black ink cartridge BC and color ink cartridge CC moves to the maintenance area MA and stands by for subsequent printing at the position. Also, when the standby time to printing elapses past a prescribed period of time or the main power source is turned off by an operator, the carrier 1 moves to the home position HP provided in the maintenance area MA. At this time, the caps 3B and 3C are brought into contact with the nozzles BC1 and CC1 provided on the underside of the black ink cartridge BC and color ink cartridge CC, thereby preventing ink from drying up at the nozzles BC1 and CC1.

The nozzle caps 3C and 3B are attached to the sled 4 via the nozzle cap holders 5C and 5B. Since the sled 4 is elevated in line with the movement of the carrier 1 when the carrier 1 advances from the printing area PA into the maintenance area MA, the nozzle caps 3C and 3B are brought into contact with the nozzles CC1 and BC1, described later, of the color ink cartridge CC and black ink cartridge BC mounted in the carrier, and carry out capping.

When printing is commenced from a state where the carrier 1 stands by at the home position HP, the carrier 1 makes a pause once at the preliminary discharge position SP where the carrier 1 only slight moved from the home position HP, and preliminary discharge is carried out by the nozzles BC1 and CC1 of the black ink cartridge BC and color ink cartridge CC, by which a slight amount of ink is discharged to perform preparatory motions by which clogging of the nozzles BC1 and CC1 is removed.

The preliminary discharge position SP is a position where the sled 4 is not sufficiently lowered. Ink flow-out pores 41 are provided at the position immediately below the nozzle BC1 of the black ink cartridge BC at the preliminary discharge position SP of the sled 4, and the ink receiving cup 6 is provided at a position further below the position. In addition, ink flow-out pores are not provided at a position immediately below the nozzle CC of the color ink cartridge CC. However, since the viscosity of the color inks is low and the fluidity thereof is high, the color inks are caused to flow into the ink receiving cup 6 through ports for production and maintenance, which are provided on the sled 4.

Figure 2A:
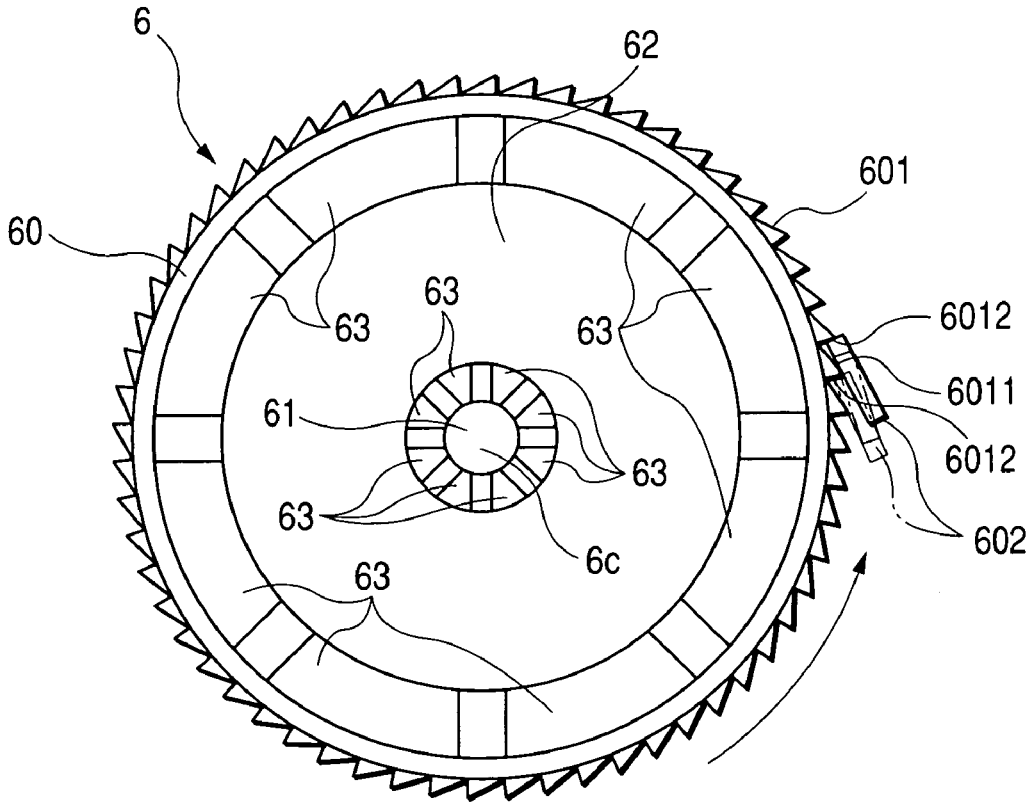
FIG. 2A is a general front elevational view of an ink receiving cup employed in an image forming apparatus according to the invention.
Figure 2B:
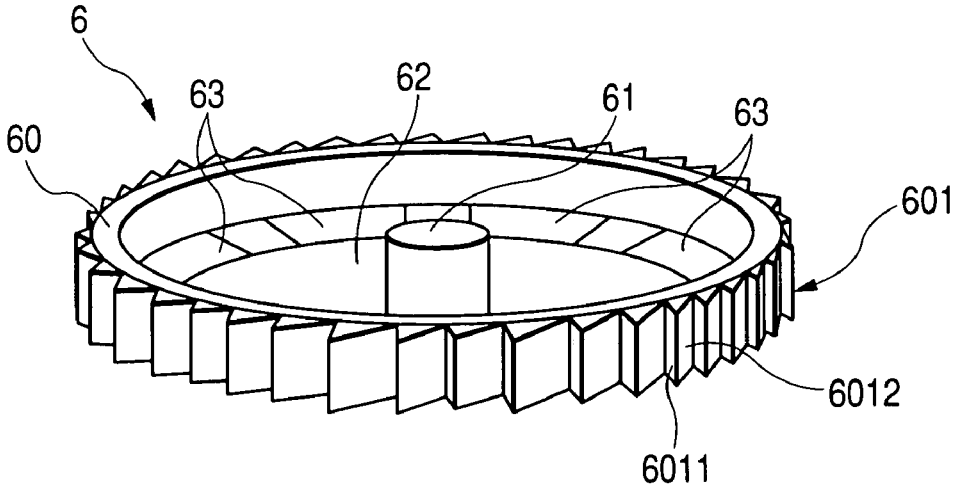
FIG. 2B is a perspective view showing the ink receiving cup shown in FIG. 2A.

FIGS. 2A and 2B are a plan view and a perspective view of the ink receiving cup employed in the image forming apparatus of the invention.

The ink receiving cup 6 shown in FIG. 2A is cylindrically shaped with its top open. The ink receiving cup 6 is provided with a cylindrical top portion 60, a bearing portion 61 into which the center shaft of rotation is fitted when the ink receiving cup 6 is rotated at the central portion 6*c*, a black ink accumulating portion 62 where black ink is sprayed and accumulated, and a plurality of through-holes 63 at the outer-circumferential side and inner-circumferential side of the black ink accumulating portion 62 for causing color inks to flow.

The outer circumferential side of the cylindrical portion 60 of the ink receiving cup 6 has serrated projections and recesses 601. As shown in FIG. 2A, the projections and recesses are pressed in one direction by a cup pressing member 602 having flexibility, which is provided at the lower part of the sled 4. The mechanism of pressing the same in one direction is as follows. That is, the ink receiving cup 6 is attached to an axis so that it is permitted to turn only in one direction (herein, in the counterclockwise direction in the drawing). The cup pressing member 602 is rectangular, in which the thickness direction is very softly formed while the strength in the lateral direction is secured.

The serrated projections and recesses 601 are provided with major side portions 6011 and minor side portions 6012. When the carrier 1 returns to the home position HP, the sled 4 simultaneously moves to the home position HP. At this time, the cup pressing member 602 attached to the sled 4 presses a minor side portion 6012 of the serrated projections and recesses 601 to turn the ink receiving cup 6. And, the cup pressing member 602 also moves in line with movement of the sled 4. However, the cup pressing member 602 is pressed by a major side portion 6011 of the serrated projections and recesses 601 and escapes in the thickness direction. Similarly, by repeating the movements of the sled 4, the ink receiving cup 6 is caused to rotate in the counterclockwise direction.

FIGS. 3A to 3E are general views showing the movements of the carrier, sled and ink receiving cup.

Figure 3A:
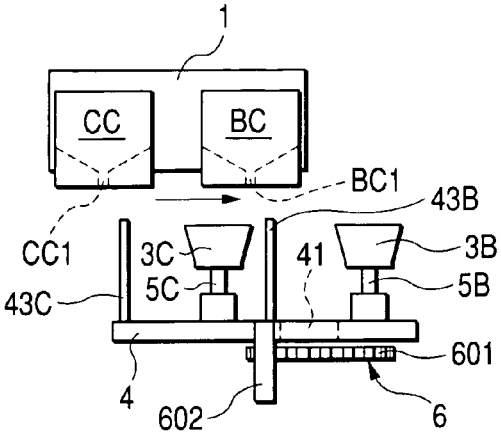
FIGS. 3A through 3E are views showing movements of the printer shown in FIG. 1.

FIG. 3A shows a state where the carrier 1 of the printer Pr shown in FIG. 1 advances into the maintenance area MA. In this state, the sled 4 stands by so that the nozzle cap faces 31B and 31C of the nozzle caps 3B and 3C come to a lower position than the underside (ink head CH1 and BH1) of the color ink cartridge CC and black ink cartridge BC. Further, the ink receiving cup 6 is attached to be rotatable downward of the sled 4.

Figure 3B:
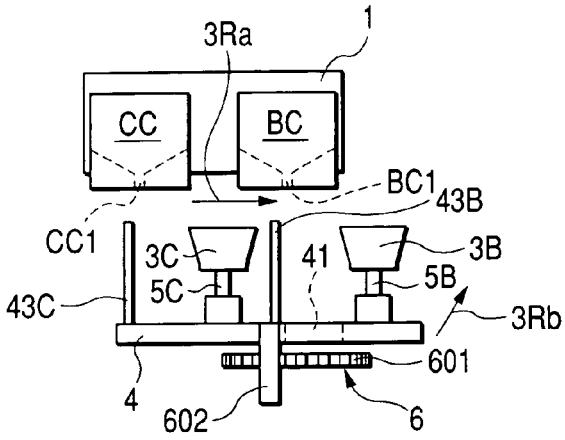

As shown in FIG. 3B, as the carrier 1 advances into the maintenance area MA (the position shown by the arrow 3Ra in the drawing), the sled 4 is lifted by a lifting mechanism (not illustrated) for lifting the sled 4 utilizing a force by which the carrier 1 is moved. The sled 4 moves in the upper and lower directions, and at the same time, it moves in a lateral direction, following the carrier 1. That is, the sled 4 is elevated in the diagonally upper direction (the direction shown by the arrow 3Rb in the drawing) of the advancement of the carrier 1.

Figure 3C:
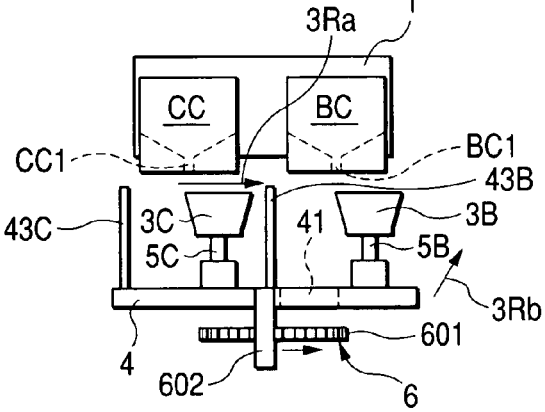

As shown in FIG. 3C, as the carrier 1 further advances, the nozzle caps 3B and 3C are brought into contact with the ink heads BH1 and CH1 of the black ink cartridge BC and color ink cartridge CC, which are attached to the carrier 1. At this time, the carrier 1 moves in the direction of the arrow 4C, that is, in the rightward direction (the arrow 3Ra) of the drawing, and the sled 4 and the nozzle cap holders 5C and 5B with which the nozzle caps 3B and 3C are engaged diagonally move rightward in the drawing (that is, in the direction of the arrow 3Rb). In addition, at this time, the cup pressing member 602 fixed on the underside of the sled 4 presses the serrated projections and recesses 601, which are formed on the outer circumferential face of the ink receiving cup 6, wherein the ink receiving cup 6 is turned.

Figure 3D:
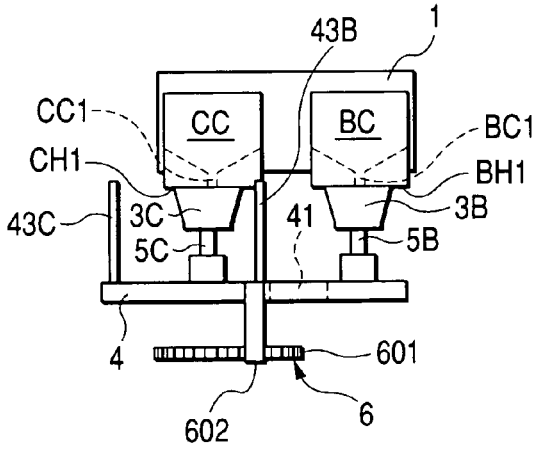

After that, as shown in FIG. 3D, the sled 4 stops in line with arrival and stop of the carrier 1 at the home position HP. At this time, the nozzle caps 3B and 3C are brought into contact with the ink heads BH1 and CH1 of the black ink cartridge BC and color ink cartridge CC mounted on the carrier 1 and enclose the ink heads BH1 and CH1 in an airtight state.

Figure 3E:
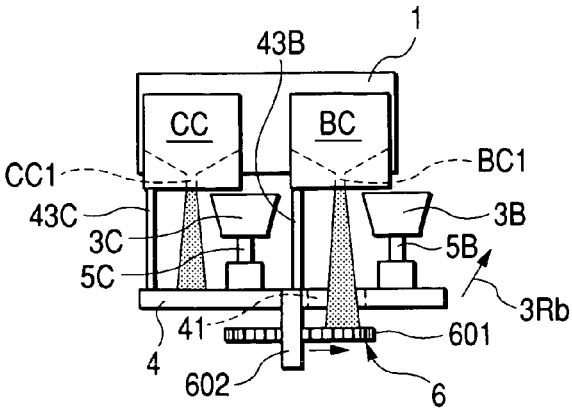

Further, when the carrier 1 moves from the home position HP for printing, it provisionally stops at the preliminary discharge position SP as shown in FIG. 3E, and discharges ink through the nozzles BC1 and CC1 for cleaning the nozzles BC1 and CC1. At this time, the ink flow-out pores 41 secured on the sled 4 are disposed downward of the nozzle BC1 of the black ink cartridge BC, and the downward portion of the ink flow-out pores 41 becomes a black ink accumulating portion 62 of the ink receiving cup 6. In addition, since the color inks have high fluidity although no ink flow-out pore is formed downward of the nozzle CC1 of the color ink cartridge CC, the inks flow from the pores including the ink flow-out pores 41 into the ink receiving cup 6.

After that, the carrier 1 moves, and simultaneously moves apart from the carrier 1. At this time, the ink heads BH1 and CH1 of the black ink cartridge BC and color ink cartridge CC move the printing area PA after unnecessary inks are wiped off by cleaning wipers 43B and 43C provided at the sled 4.

As described above, whenever the carrier 1 returns to the home position HP, the sled 4 operates in interlock with the carrier 1. Since the ink receiving cup 6 is interlocked with the sled 4, the ink receiving cup 6 moves in one direction when the carrier 1 returns to the home position HP. Therefore, when the black ink cartridge BC carries out preliminary discharge, ink is discharged toward a position of the black ink accumulating portion 62 of the ink receiving cup 6, which differs from the previous preliminary discharge. Accordingly, black ink is hardly accumulated.

In the above-described embodiment, an example is illustrated, in which an operating mechanism of the ink receiving cup is brought about by the cup pressing member pressing the serrated projections and recesses. The operating mechanism is not limited to the above-described example. Any other types may be widely employed, in which inks are discharged to a position differing from the discharge position of the previous preliminary discharge in which the ink receiving cup turns in line with movement of the carrier.

Further, a cup-shaped member is employed as a member for receiving ink discharged by preliminary discharge. The member is not limited to the above-described example. Various types may be employed, for example, a ring-shaped type in which a belt is connected, and black ink can be discharged to a position differing from the previous preliminary discharge position.

According to the present invention, it is possible to provide an image forming apparatus which does not hinder movements of movable parts such as the carrier, sled, etc., resulting from accumulation of black ink, and is capable of carrying out preliminary discharge while preventing stains of document images from occurring due to splattering of color inks.

What is claimed is:

1. An image forming apparatus for printing a document image having images and characters by spraying ink onto a medium, comprising:

a carrier for holding a black ink cartridge and a color ink cartridge;

nozzle caps for preventing ink, which exists in nozzles of the black ink cartridge and color ink cartridge and in a vicinity of the nozzles, from drying while the carrier is in standby for a next printing action;

nozzle wipers for wiping off unnecessary ink existing in the nozzles of the black ink cartridge and color ink cartridge and in the vicinity thereof when the carrier commences an action from the standby state;

a sled for supporting the nozzle caps and nozzle wipers and approaching the carrier in line with a movement of the carrier; and an ink receiver cup, which is disposed downward of the sled, for rotating in one direction in line with the movements of the sled, wherein:

the black ink cartridge and color ink cartridge carries out a preliminary discharge by which ink is discharged from the nozzles to the ink receiver cup before commencing printing on a medium or by an instruction of a user; and the ink receiver cup has a plurality of flow-out pores, through which color inks flow out, formed at positions where the strength of the ink receiver cup is not remarkably lowered, at portions other than a part on which black ink is sprayed through the preliminary discharge.

2. An image forming apparatus for printing a document image having images and characters by spraying ink onto a medium, comprising:

an ink receiving member for receiving ink discharged in a preliminary discharge;

an ink accumulating portion for accumulating ink having high viscosity; and an ink discharging portion for discharging ink having low viscosity, wherein:

the ink receiving member includes the ink accumulating portion and the ink discharging portion; and in the preliminary discharge, the ink accumulating portion accumulates the ink having high viscosity in a place differing from that for the ink discharging portion.

3. The image forming apparatus according to claim 2, wherein:

the ink receiving member is an ink receiving cup having a cylindrical shape with its top part open;

the ink receiving cup includes ink flow-out pores penetrating from a bottom plane to an outside, as the ink discharging portion; and the flow-out pores are circular arcs having a prescribed center angle and has a prescribed width in a radius direction, and the flow-out pores are disposed on an inner circumferential side and an outer circumferential side of the ink accumulating portion at intervals composed of an equal-center angle with respect to a center portion of the ink receiving cup.

* * * * *